United States Patent [19]

Hiranishi

[11] 4,222,124

[45] Sep. 16, 1980

[54] QUILTED CLOTHING WITH REINFORCED SEAM

[76] Inventor: Michiko Hiranishi, 7-4-3, Akasaka, Minato-ku, Tokyo, Japan

[21] Appl. No.: 930,522

[22] Filed: Aug. 3, 1978

[30] Foreign Application Priority Data

Sep. 9, 1977 [JP] Japan ..... 52-120592[U]

[51] Int. Cl.[2] ..... A41D 1/00

[52] U.S. Cl. ..... 2/93

[58] Field of Search ..... 2/255, 93, 87, 94, 275, 2/97, 52; 112/418, 141, 142, 143

[56] References Cited

U.S. PATENT DOCUMENTS

| | | | |
|---|---|---|---|
| 2,095,886 | 10/1937 | Neuman | 2/275 X |
| 2,114,922 | 4/1938 | Glasmann | 2/52 X |
| 2,153,352 | 4/1939 | Steinberger | 2/93 X |
| 2,696,006 | 12/1954 | Tuck | 2/255 X |

*Primary Examiner*—Doris L. Troutman

*Attorney, Agent, or Firm*—Larson, Taylor and Hinds

[57] ABSTRACT

Clothing made of quilted cloth, without using backing or interlining cloth, with the free cut marginal edges being finished with a flat seam so that the folded edge portions have a plain weave cotton tape interposed therebetween to be machine-sewn in two rows.

4 Claims, 6 Drawing Figures

QUILTED CLOTHING WITH REINFORCED SEAM

BACKGROUND OF THE INVENTION

The present invention relates to clothing, and more particularly to clothing made of quilted cloth.

The term "quilted cloth" referred to in the present disclosure means strong cotton cloth Sashiko existing in Japan from old times and generally used at present as material for judo and Japanese fencing wear. The quilted cloth is generally divided into two kinds: i.e. one referred to as Betazashi in which cotton cloth is minutely and closely stitched with thick cotton threads running parallel to each other the other referred to as Kashizashi in which two layers of cotton cloth is coarsely stitched by two layers of medium threads running in two different directions, each line of each set is parallel to and spaced significantly from the adjacent line and the lines of one set intersect the lines of the other set at an angle (such as 90°) so that the stitched cotton threads represent a lattice pattern. It is Betazashi cloth that exhibits a unique characteristics as cloth. Since the cloth has an extraordinary thickness and stiffness as a fabric for clothing due to the close parallel spacing of the thick cotton threads, it has been hitherto deemed unappropriate for general clothing and has been used solely as cloth for judo wear, etc. where great importance is attached to strength. Moreover, since the sewing of the quilted cloth is relatively difficult it has seldom been applied to general use other than judo wear, etc. However, it has been well recognized that the quilted cloth has such advantages as strength, good absorbability of sweat, unique characteristics and appearance, etc.

SUMMARY OF THE INVENTION

It is an object of the present invention to provide clothing in which quilted cloth is used as the principal material taking advantage of its merits as abovesaid.

It is another object of the present invention to provide clothing in which quilted cloth is used as the principal material and which is easy to manufacture.

It is a further object of the present invention to provide clothing which is excellent in design, gives a good feeling during wear, and is low in cost.

In accordance with the present invention, clothing is provided in which Betazashi cloth or Betazashi cloth together with Kashizashi cloth are used as the principal material, without using interlining cloth, and the free cut marginal peripheries other than the sewn peripheries are doubly folded and flat seamed or hemmed with reinforcing cotton tapes being interposed therebetween to be machine-sewed together in two rows, whereby collar portions are formed solely of onehold Betazashi cloth except for the portions which are folded and hemmed with cotton tape.

There are two technical problems encountered when thick and stiff "Betazashi" cloth is sewed for the object of making clothing. One problem resides in that when the collar portions are formed by doubling the cloth in accordance with the conventional manner not only do extraordinarily thick portions appear at the collar portions so that they are hard to finish in good shape, but also the weight becomes so heavy that the wearer is given a very bad feeling. Another problem resides in as to how the free cut marginal peripheries other than the sewn peripheries can be finished simply, strongly and finely without the danger of fraying. In solving these problems it should be taken into consideration that the advantages of the quilted cloth should not be lost due to the adoption of complicated procedures.

The present invention has suceeded in solving these problems by the adoption of a unique technique as outlined above and explained in detail below.

BRIEF DESCRIPTION OF THE DRAWINGS

These and other objects of the present invention will become more readily apparent upon reading of the following specification and upon reference to the accompanying drawings in which.

DESCRIPTION OF THE PREFERRED EMBODIMENTS

Figure 1:
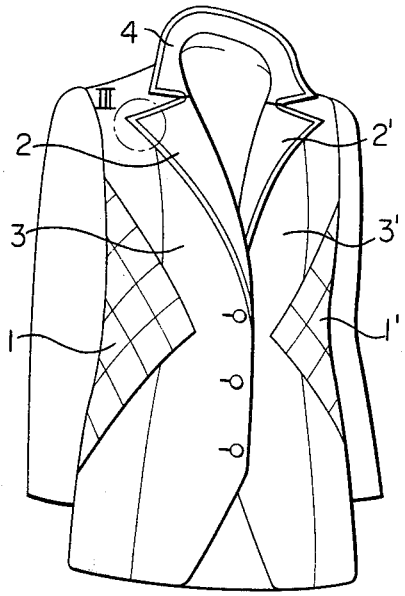
FIG. 1 is a perspective view of one embodiment of the present invention.
Figure 2:
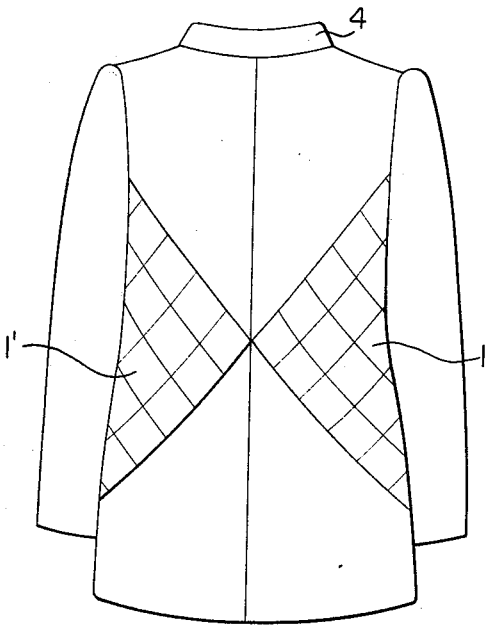
FIG. 2 is a rear view of FIG. 1.

In a woman's suit embodying the present invention, as shown in FIGS. 1 and 2 of the drawings, respectively a perspective frontal view and a rear elevational view, the suit is made of randomly quilted cloth except for the square shaped directionally quilted "Kashizashi" cloth 1, 1' which are sewn ornamentally to the trunk portion at the right and left sides. No interlining cloth is used at all. Among the collar portions 2, 2', which are opened broadly at the breast part, are so shaped that they are integral with front parts 3, 3' and formed from the cut cloth common to the front parts 3, 3', no double constitution as conventional in dress making being adopted. Therefore, no interlining cloth is used. Thus, the collar portions 2, 2', since they are formed only by folding the elongated parts of the front portions 3, 3' reveal the rear surfaces of the cloth. However, even though the appearance of the rear surface of quilted cloth is not identical to that of the front surface, the rear surface at the collar portions 2, 2' is not necessarily unsightly; instead it presents a novel design together with folded portions 6 (these being the front surfaces) of the margins to be described fully later. Also the remaining rear portion 4 of the collar reveals the rear surface of the quilted cloth.

Figure 3:
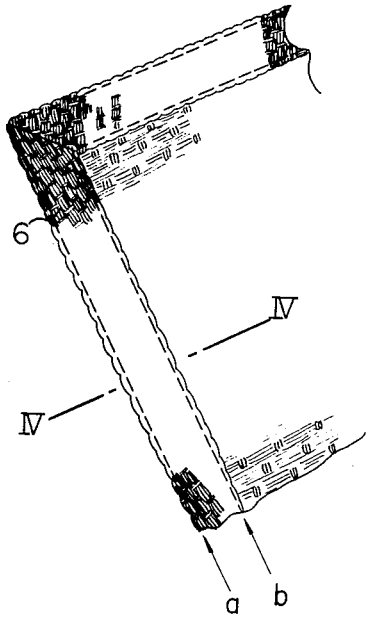
FIG. 3 is a perspective view of a portion of FIG. 1 encircled by the circle III in an enlarged scale.
Figure 4:
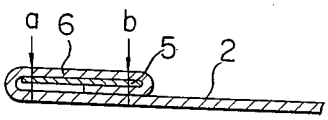
FIG. 4 is a sectional view taken along the line IV—IV in FIG. 3.
Figure 5:
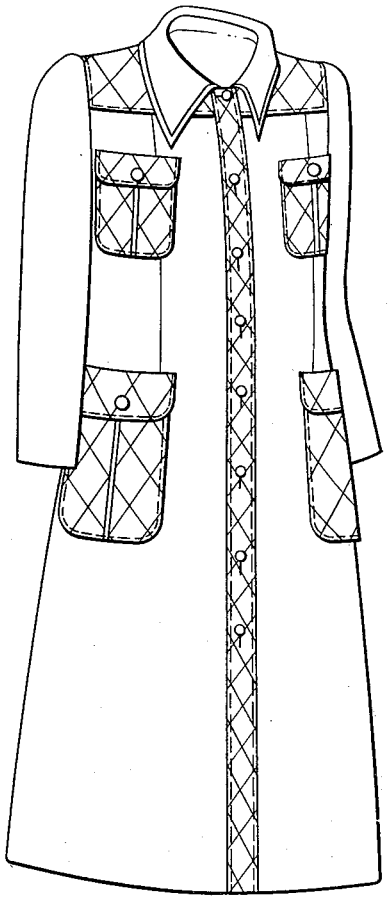
FIG. 5 is a perspective view of another embodiment of the present invention.
Figure 6:
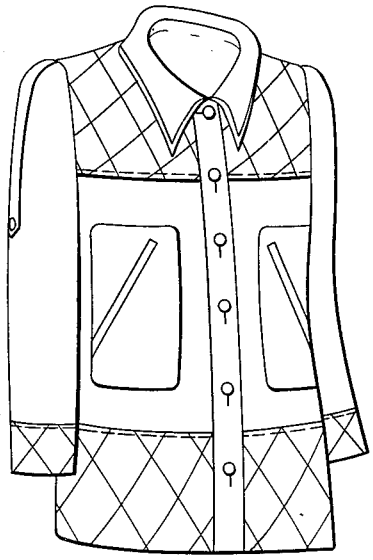
FIG. 6 is similar view to FIGS. 1 and 5 showing still another embodiment of the present invention.

The detail of the marginal free cut portion of the collar is shown in FIGS. 3 and 4. As apparent from these, the marginal portion is constituted such that after the free edge portion of the cloth is doubly folded, i.e. hemmed with a cotton plain weave tape 5 being interposed therebetween to form a flat seam 6, the flat seam 6 is machine-sewn together with the tape 5 in two rows at a and b, whereby the flat seam 6 is firmly secured. It was found preferable that the width of the cotton tape 5 be selected to be 10 mm, the width of the flat seam 6 being 13 mm. Such a procedure for fixing the free marginal portions of the suit is carried out at not only the collar portions, but also at all of the other free cut marginal portions such as the front portions 3, 3' which are continuous with the collar portions 2, 2', skirt portion, etc.

As to the finishing of the free cut marginal portion, if it is for the object of only preventing fraying of the cloth, the procedure that after the marginal portion is folded once or twice the folded portion is machine-or manually sewn to fix it may be sufficient. However, such a simple finish procedure causes the shape of the suit to be largely destroyed after it has begun to be worn. This is due mainly to the directionality in elongation and washing shrinkage percentage in randomly quilted cloth. In accordance with the present invention the manufacture of clothing having a good shape stability with the use of quilted cloth only, i.e. without the use of backing and/or interlining cloth, has been made possible for the first time by finishing the marginal free cut portions in the manner explained above.

In this connection, it should be appreciated that the cotton tape used for finishing the marginal free portions has to be of the usual plain weave, and its warps have to elongate in the length direction. However, so-called bias tape does not exhibit a similar effect to that of plain weave tape in finishing the marginal portion. A width of the tape of 10 to 20 mm was found suitable.

What is claimed is:

1. Clothing having a collar characterized in that quilted cloth "Sashiko" is utilized as the main material without backing and the free cut marginal edges are doubly folded and hemmed with a flat seam with a reinforcing tape being interposed between the double folded hem so as to be machine-sewn with stitches in plural rows together with said cloth lying above and below said tape, whereby collar portions are formed solely of onehold "Betazashi" cloth except for the marginal portions which are folded and hemmed with tape.

2. Clothing as claimed in claim 1 wherein said quilted cloth Sashiko is Betazashi cloth used singly or together with Koshizashi cloth.

3. Clothing as claimed in claim 1 wherein said reinforcing tape is a plain weave cotton tape.

4. Clothing as claimed in claim 3 wherein the width of said plain weave cotton tape is 10 to 20 mm.

* * * * *